United States Patent [19]

Kearns

[11] Patent Number: 4,527,785

[45] Date of Patent: Jul. 9, 1985

[54] MACHINE TOOL APPARATUS

[75] Inventor: Vaughn Kearns, Larue, Ohio

[73] Assignee: United Aircraft Products, Inc., Dayton, Ohio

[21] Appl. No.: 599,598

[22] Filed: Apr. 13, 1984

Related U.S. Application Data

[63] Continuation-in-part of Ser. No. 383,484, Jun. 1, 1982, abandoned.

[51] Int. Cl.[3] ..... B25B 1/08

[52] U.S. Cl. ..... 269/71; 269/75; 269/104; 269/138; 269/152

[58] Field of Search ..... 248/639, 181, 288.5; 403/90; 269/75, 104, 152, 71, 79, 45, 138, 155

[56] References Cited

U.S. PATENT DOCUMENTS

| | | | |
|---|---|---|---|
| 541,863 | 7/1895 | Loonmis | 403/90 |
| 1,788,652 | 1/1931 | Andrew et al. | 269/104 |
| 2,669,958 | 2/1954 | Sweeney | 269/45 |
| 2,898,068 | 8/1959 | Warren | 269/75 |
| 3,849,945 | 11/1974 | Lindzy | 269/75 |
| 4,054,281 | 10/1977 | Martinsson | 269/155 |
| 4,209,166 | 6/1980 | De Roven | 269/104 |

FOREIGN PATENT DOCUMENTS

| | | | |
|---|---|---|---|
| 716790 | 1/1942 | Fed. Rep. of Germany | 269/79 |
| 544254 | 9/1922 | France | 269/75 |
| 971458 | 7/1950 | France | 269/138 |

*Primary Examiner*—Robert C. Watson
*Attorney, Agent, or Firm*—J. E. Beringer

[57] ABSTRACT

For use in a milling or like machine, a fixture is provided to hold a part to be machined, the fixture including portions to clamp the part against relative shifting motion. A mount for the fixture includes components movable in tilting and vertical senses whereby a previously machined surface on a held part may be brought into mating contact with a reference surface in the machine thereby locating the part for a succeeding machine operation. A single means is operable to lock the components in a set position of adjustment. The part is firmly held in an unstressed condition for precise performance of the succeeding machine operation thereon.

21 Claims, 10 Drawing Figures

MACHINE TOOL APPARATUS

This is a continuation-in-part of co-pending application Ser. No. 383,483, filed June 1, 1982, now abandoned.

BACKGROUND OF THE INVENTION

1. Field of the Invention

This invention relates to machine tool apparatus, and particularly to apparatus for a stress-free holding of a part for machining.

2. Description of the Prior Art

A machine tool apparatus of the kind to which this invention relates provides a fixture into which a part or a work piece is clamped and held while one or more machining operations is performed thereon. When plural machining operations are required, the part is released, repositioned so that a first machined surface thereon properly contacts a machine reference surface, and then again clamped in the fixture so that a second machining operation can take place, which operation is precisely related to the first. In the case of irregularly shaped precision castings, and other not inherently rigid parts, adjustment of the fixture to re-clamp a reference surface positioned part may distort the part causing a second machined surface not to have the relationship to the first machined surface required by part design. Efforts have been made to deal with this problem by relatively elaborate arrangements of independent clamping devices involving multiple individual adjustments. As known, prior art arrangements yield inconsistent results, related largely to the skill of the adjuster, and in any event substantially increase the labor time involved in producing a machined part. A concept of a fixture adjustable to conform to part configuration and location, without applied stress, is unknown in the prior art as is a concept of a single means locking the fixture against motion in plural senses after it has been adjusted to and clamped to the part.

SUMMARY OF THE INVENTION

The instant invention avoids stress and distortion in a held part by providing a mount for a fixture capable of tilting and relative raising and lowering movements. A fixture and clamped part may accordingly be freely moved about while a first machined surface is brought to bear on a reference surface. Following this, the fixture mount is locked in an adjusted position. The part is thereby held rigidly for subsequent machining with no applied stress. A single means in the form of a lever is operable to fix and to release the fixture mount. The latter in an illustrated form of the invention includes a table to which the fixture is secured, a post supporting the table, and a split ball in which the post is reciprocably mounted, the ball being freely rotatable. The ball is received between clamp members and a lever is movable to and fro in an arcuate sense to open and close the clamp members upon the ball and thereby upon the table post, alternately freeing and locking the ball and post from motion relative to the clamp members. A stabilizer mechanism is provided controlling movement of the fixture in one sense.

An object of the invention is to provide fixture holding and mounting and controlling apparatus in a machine tool or the like, substantially in accordance with the foregoing.

Other objects and structural details of the invention will appear more clearly from the following description, when read in connection with the accompanying drawings, wherein.

Figure 1:
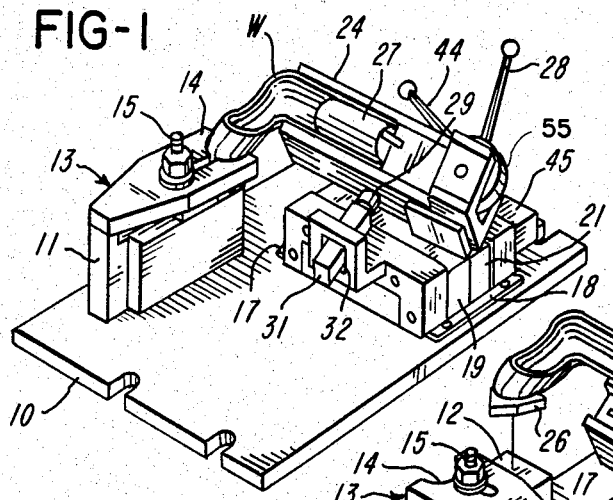
FIG. 1 is a view in perspective of a fixturing apparatus in accordance with an illustrated embodiment of the invention, showing a part in a fixture and the fixture locked in position.

Referring to the drawings, fixturing apparatus according to the illustrated embodiment of the invention includes a base plate 10 adapted to be mounted to the bed of a milling or like machine to be a removable part thereof. Upstanding from the base 10, to one side thereof is a block 11, an upper surface of which is precisely machined to define a reference surface 12. A face clamp 13 is pivotally mounted on the block 11 and serves, as will hereinafter more clearly appear, to clamp a machined surface of a part to the reference surface 12. The clamp 13 has a yoke shaped end 14 and is rotatable on an upstanding stud 15 carrying a screw means adjustable to fix the clamp in a selected position of rotary adjustment. Also mounted on and upwardly facing of base plate 10 is a pair of laterally spaced apart guide members 17 and 18 fixed to the base plate. Between the guide members 17 and 18 are opposing and relatively movable clamp members 19 and 21 which, as substantially digramatically shown in FIG. 3, have diametrically opposed hemispherical recesses 22 and 23 in their adjacent confronting edges. Superimposing over the clamp members 19 and 21 is a fixture body 24. The fixture is open and recessed at what may be regarded as an upper face thereof. Within such front face it accommodates a semi-cylindrical body portion 25 of a part or work piece W. The part W extends at one end from the fixture body 24 and is bent to have a flanged outer end 26 overlie the reference surface 12 on block 11. The recessed upper face of the fixture body has means therein, including a pivotal tongue 27 operating under control of a lever 28 to clamp or to hold the part W within the recessed upper face thereof, positioning a portion of the part for machining. The tongue 27 and a means operated by lever 28 will hereinafter be considered in detail. At the front of the fixture body is a pivotal joint 29 from which extends a stabilizer arm 31. The arm projects forwardly to and through an aperture 32 in a stabilizer guide member 33 secured to and upstanding from the clamp member 19 on base plate 10. Arm 31 is freely movable in an axial sense within aperture 32 and has a limited capability of relative tilting motion, shared by the fixture body to which it is connected.

The fixture body 24 rests on and is secured to a table 34 appearing on the upper end of a post 35. The latter orients in a vertical sense and extends downward between the confronting edges of the clamping members 19 and 21. At a lower end thereof, the post 35 is recessed to receive a compression spring 36 and a support stud 37. The latter bears on a hardened plate 28 resting on the upper surface of base plate 10. The spring 36 is relatively strong and properly positions the table 34 and its supported fixture body 24 while accommodating a tilting movement of the post, table and supported load. The hemispherical recesses 22 and 23 cooperate in defining a cavity for a ball 39 having a through axial bore 41 and radial slot 42. The latter gives the ball a split construction while the bore 41 provides for the relatively close fitting passage of post 35 therethrough. As will be understood, a relative approaching motion of the clamping members 19 and 21 compresses the ball 39, closing it upon post 35 and imparting a frictional resistance to rotation of the ball. A relative separating motion of the clamping members releases the applied pressure, allowing ball 39 freely to rotate and allowing post 35 to be raised and lowered in a vertical sense. A stud 43 is set in the clamping member 19 and projects through an aperture in clamping member 21 to extend to the rear thereof. A lever 44 has a portion 45 in threaded engagement with the projecting portion of stud 43 and provides a surface 46 in an abutting engagement with clamping member 21. In this regard, the relative approaching and separating motions of the clamping members 109 and 21 is accomplished by making the clamping member 21 relatively slidable on the surface of base plate 10 while clamping member 19 is secured to the base plate. An arcuate to and fro movement of lever 44 causes lever portion 45 to move axially on threaded stud 43 whereby to apply and to release a clamping effect on split ball 39 through a pressuring and a release of movable clamping member 21.

In the use of the fixturing apparatus, a part W, the undersurface of flange 26 of which has been machined in a preceding operation, is placed in the fixture body 24 with the machined end projecting therefrom and overlying reference surface 12. Lever 28 is actuated to clamp the part in the fixture and then the assembly comprising the fixture body, held part and table 34 is adjusted as required to seat the previously machined surface or the part squarely or flushly to the reference surface 12. Any adjustments required to accommodate a proper seating of the machined surface to the reference surface is absorbed in a conforming movement of the fixture and in the mounting mechanism therefor and is accomplished with no applied stress to or distortion of the part W. It will be understood that during this adjustment process, the lever 44 occupies an arcuate position of adjustment releasing pressure on clamping member 21 and thereby on ball 39. When the part W has been properly located, however, lever 44 is rocked in a direction to effect an approaching motion of clamping member 21 toward clamping member 19 with the result that ball 39 and post 35 are locked in their adjusted positions. The fixture and held part are accordingly also locked in a located position of adjustment and the apparatus is positioned for a succeeding machining operation in which a machined surface will have a precise design relationship to the previously machined surface.

The invention has been disclosed with respect to one illustrated embodiment, and certain modifications in such embodiment have been discussed. It will be understood that these and other modifications within the scope of persons skilled in the art are within the intent and comprehension of the invention.

The mount 34 and supported fixture 24 may, in the absence of applied clamping pressure, move freely in vertical and tilting motions without interference from stabilizer bar 31. A bodily rotational motion, however, is inhibited by complementary configurations of bar 31 and aperture walls 32 as indicated.

Figure 2:
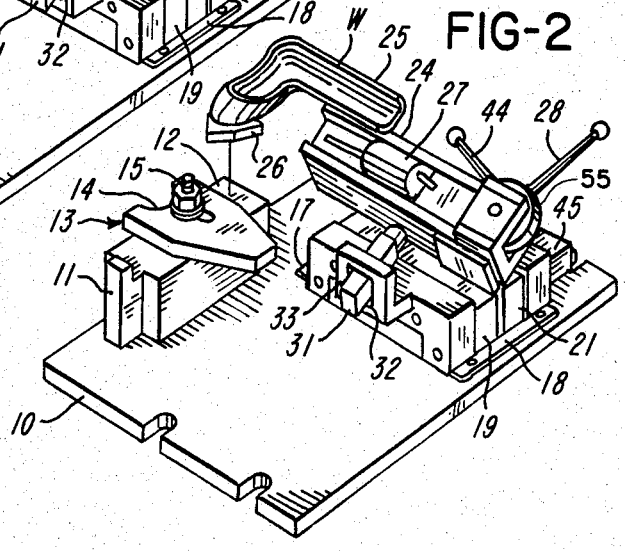
FIG. 2 is a view similar to FIG. 1, showing a part being positioned in the fixture.
Figure 4:
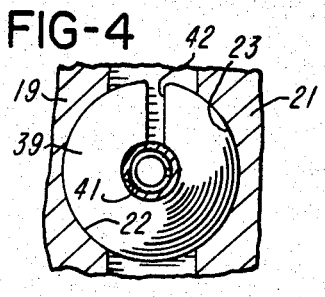
FIG. 4 is a detail view of a ball member comprised in the mount components.
Figure 3:
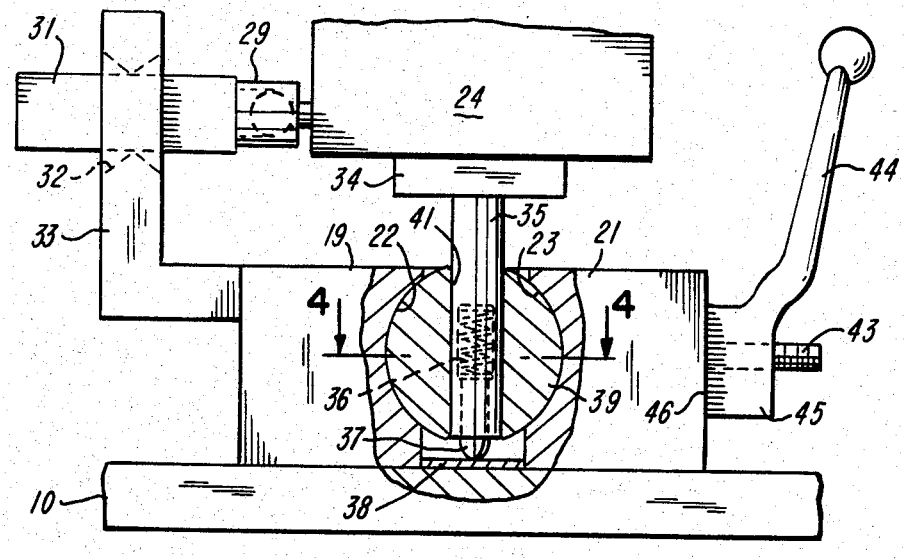
FIG. 3 is a view in cross-section, and partly diagramatic, showing fixture mounting components.
Figure 5:
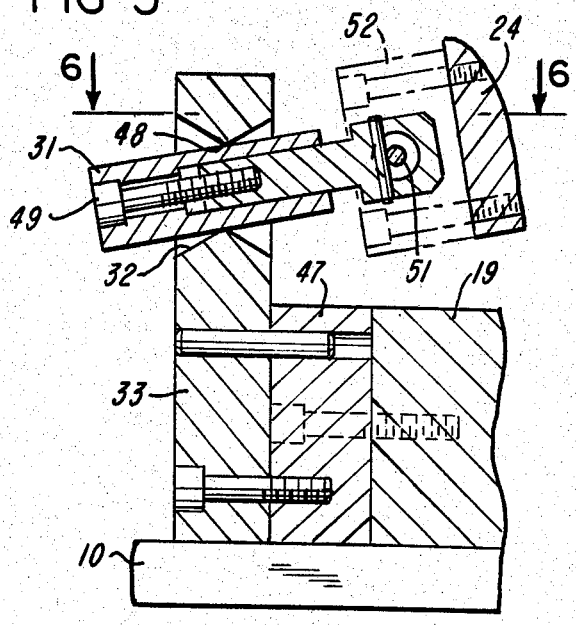
FIG. 5 is a detail fragmentary view of a stabilizer arm mechanism.
Figure 6:
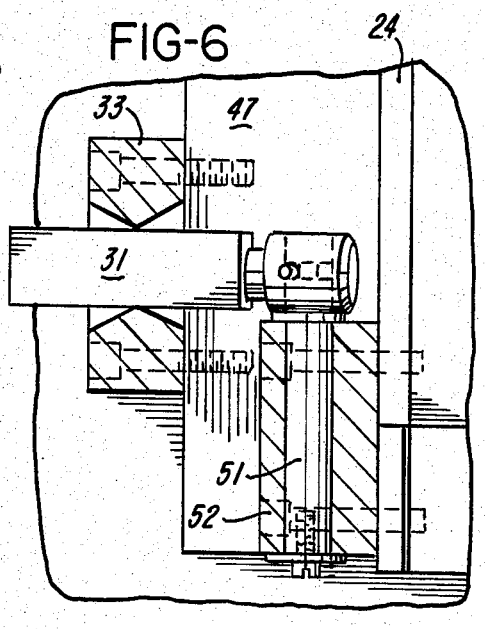
FIG. 6 is a view in cross section taken substantially along the line 6—6 of FIG. 5.

A form of stabilizer arm mechanism is shown in FIGS. 5 and 6, representing a physical embodiment of mechanism more diagrammatically shown in FIGS. 1–3. As there seen, guide member 33 is fixed to relatively stationary clamp member 19 through a spacer bar 47. Aperture 32 therein is formed by countersinks on opposite sides thereof leaving central apex portions 48 with respect to which the square configured arm 31 has a sliding fit. The arm 31 has a two-part construction and a screw 49 for precise adjustments of length. The outer end of the stabilizer arm is pinned for relative rotary motion to a generally perpendicularly orienting shaft 51 set in a spacer member 52 carried by the fixture body 24. Elevating and lowering motions of the body 24, and tilting movements thereof, are accommodated in the stabilizer mechanism but relative rotational movements are denied.

A form of part holding mechanism is shown in FIGS. 7–10, representing a physical embodiment of mechanism more diagrammatically shown in FIGS. 1–3. The fixture 24 has upstanding side walls 53 and 54 defining a recessed area receiving part W. It is at one end formed with angularly orienting bracket arms between which a cam-wheel 55 is rotatably mounted. Lever 28 is set in the periphery of cam-wheel 55.

The tongue 27 is pinned near one end to a shaft 56 mounted transversely between the side walls 53 and 54. It can be raised about shaft 56, to allow part W to be placed within the fixture body, and then lowered to effectively seat within the part. In the fixture wall 53 are installed spring urged actuators 57 and 58. The placement of part W into the body deflects actuators 57 and 58, the springs of which are accordingly stressed to urge part W laterally against wall 54. Also, the tongue 27 carries a relatively longitudinally movable pressure applying pin 59 projectible through one side of the tongue to engage part W and further urge it into contact with wall 54. The pressure of actuators 57 and 58 and of pin 59 secures the part W in a lateral sense and tends to hold the tongue in a lowered position.

The shorter length of tongue 27, rearwardly of shaft 56, has a cut-out portion 61 into which one end of pin 59 extends. Adapted to engage and project pin 59 is a plunger 62 mounted in one of the body bracket arms between which cam-wheel 55 is positioned. A screw plug 63 closes a body passage receiving plunger 62 and confines a spring 64 which provides the motive force to extend plunger 62 and thereby to project pin 59. A perpendicularly projecting stud 65 on plunger 62 extends through the plunger mounting body arm and into cooperative relation with cam-wheel 55. The latter has in one face thereof a recess 66 the defining wall of which is generally circular except for a flat portion 67. Stud 65 extends into recess 66 and under the urging of spring 64 engages the recess wall. With stud 65 engaged with flat portion 67, plunger 62 occupies a retracted position, compressing spring 64. If the cam-wheel is rotated to move flat portion 67 out of cooperative relation with stud 65 spring 64 is released to project plunger 62 and thereby to push on pin 59.

That side of cam-wheel 55 in which recess 66 appears is formed as an inclined, ramp-like surface 68. A lowermost portion thereof is adjacent to flat wall portion 67, and from such lowermost position the ramp-like surface rises to an uppermost portion opposite wall 67. The cam-wheel positions to have a peripheral portion underlie that end of tongue 27 occupied by cut-out 61. A peripheral notch 69 allows non-interfering, pivotal movements of the tongue in one position of rotary movement of the cam-wheel.

Figure 7:
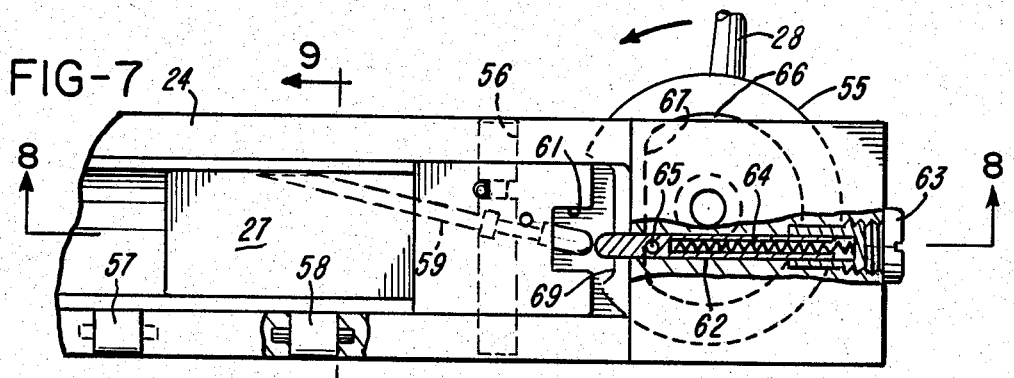
FIG. 7 is a detail fragmentary view of a part holding mechanism.
Figure 8:
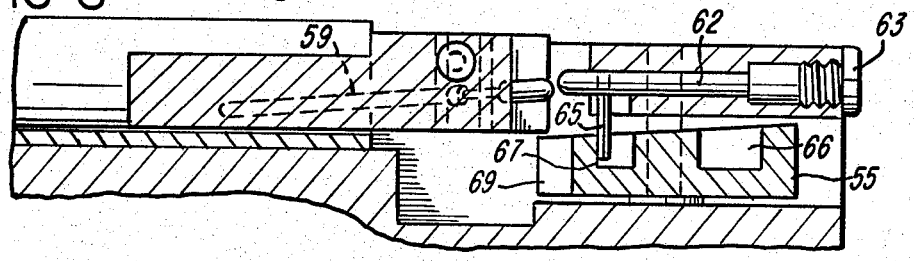
FIG. 8 is a view in longitudinal section, taken substantially along the line 8—8 of FIG. 7.
Figure 9:
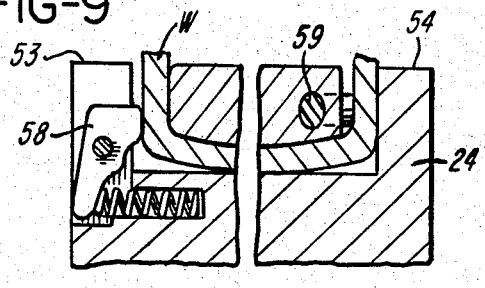
FIG. 9 is a view in cross section taken substantially along the line 9—9 of FIG. 7.
Figure 10:
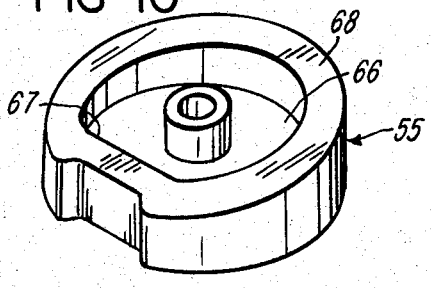
FIG. 10 is a detail view in perspective of a cam member comprised in the holding mechanism.

In the mounting of part W in the fixture, the tongue 27 is lifted to allow the part to be inserted between side walls 53–54 substantially as seen in FIG. 9. In the process, actuators 58 are deflected and then allowed to press the part in a lateral sense against wall 54. The tongue 27 then is lowered to nest in the part W which accordingly is held at this time between the tongue 27 and interior portions of body 24. To achieve a locking of the part in its held position, lever 28 is operated to turn the cam-wheel 55 an appropriate arcuate distance in a counterlikewise direction (FIG. 7). In the course of this motion, flat wall portion 67 moves out of cooperative relation with stud 65 and plunger 62 is allowed to project pin 59, seating part W more firmly into contact with body wall 54. Further in the course of arcuate cam-wheel motion, progressively steeper portions of cam surface 68 are brought to underlie tongue 27 rearwardly of shaft 56. A downward pressure thereby is exerted on a forward portion of tongue 27, that is, the portion overlying and nesting in part W. The result is effectively to lock the part W in the fixture body. When the part has been so locked, the fixture body 24, with the held part W therein, is raised or lowered and tilted as required to seat the part flange 26 flushly to reference surface 12. Clamp 13 is then applied and tightened and, finally, lever 44 is operated to retain the fixture body in the position to which it has been set.

What is claimed is:

1. In a tool for performing successive machining operations on a held part, means defining a reference surface, a fixture for holding the part, a mount for said fixture adjustable in plural senses whereby a previously machined surface on a held part may be applied to the reference surface properly to position the part for a succeeding machine operation, said mount being supported for tilting and for raising and lowering movements relative to said means defining a reference surface, and a single means operable to lock said mount in an adjusted position, said means defining a reference surface and said mount being supported on a common base, said mount including a vertically reciprocable post terminating at an upper end thereof in a table mounting said fixture, clamp members relatively slidable on said base, and a split ball member freely rotatable between said clamp members having said post reciprocable therein and said ball member being compressible by and between said clamp members, said clamp members being actuated by said single means.

2. Apparatus according to claim 1, and means independent of said mount for limiting tilting motion of said fixture in one sense only.

3. In a tool for performing successive machining operations on a held part, means defining a reference surface, a fixture for holding the part, a mount for said fixture adjustable in plural senses whereby a previously machined surface on a held part may be applied to the reference surface properly to position the part for a succeeding machine operation, said mount being supported for tilting and for raising and lowering movements relative to said means defining a reference surface, and a single means operable to lock said mount in an adjusted position, said means defining a reference surface and said mount being supported on a common base, said mount including a vertically reciprocable post terminating at an upper end thereof in a table mounting said fixture, clamp members relatively slidable on said base, and a split ball member freely rotatable between said clamp members having said post reciprocable therein and said ball member being compressible by and between said clamp members, said clamp members being actuated by said single means, one of said clamp members being fixed to the base and the other being movable on the base, a stabilizer guide mounted to the fixed clamp member and upstanding therefrom in spaced substantially parallel relation to said reciprocable post, and means extending from said fixture and interengaged with said stabilizer guide to act independently of said mount to limit tilting motion of said fixture in one sense.

4. Apparatus according to claim 1, one of said clamp members being fixed to said base and the other being in an opposed relation to the first and relatively slidable on the base, said fixed clamp member having a screw stud set therein and extending through and beyond an aperture in said relatively slidable clamp member, said single means including a lever in threaded connection with said stud and bearing on said slidable clamp member.

5. Apparatus according to claim 1, said means defining a reference surface being stationarily fixed to said base in an adjacent, separated relation to said clamp members, a held part bridging said fixture and said reference surface means, one portion of said part being held by said fixture and another portion of said part extending to a cooperative relation with the reference surface.

6. Apparatus according to claim 5, characterized by a stabilizer guide mounted in a fixed relation to said base, and a stabilizer arm pivotally connected to said fixture and being relatively reciprocable within said guide, said guide and arm cooperating to limit motion of said fixture relative to said base in one sense.

7. A tool fixture, including a fixture body, a base supporting said body for relative raising and lowering and tilting motions, said body providing a mounting place for a part to be held in said fixture, and separate mechanisms for holding the part in said mounting place and for holding said body relative to said base, said mechanisms including levers accessible to the hand of an operator separately and successively to lock a part into the fixture and to lock the body against motion relative to the base, one of said mechanisms including a lever operated cam and individual means separately engaged and operated by said cam for applying holding pressures in different senses to a body mounted part.

8. A tool fixture according to claim 7, one of said separately operated means including a tongue adapted to be lowered into a nesting relation to a mounted part, said cam having a surface engageable with said tongue to apply therethrough a holding pressure to said part in one sense.

9. A tool fixture according to claim 7, there being a tongue pivotally connected to said body adapted to be lowered into a nesting relation to a mounted part, one of said separately operated means including a pin carried by said tongue and projectible to engage a mounted part and urge it in one of said different senses, and means controlled by said cam to project said pin.

10. A tool fixture according to claim 9, said cam having a surface engageable with said tongue and acting therethrough to apply a downward holding pressure to a mounted part and said pin when projected applying a lateral holding pressure to a mounted part.

11. A tool fixture according to claim 7, said body being carried by a post resting on said body and said means for holding said body relative to said base including lever operated clamping devices to grip and to release said post.

12. A tool fixture according to claim 11, and means for limiting relative motion of said fixture body in a rotational sense, said means including a stabilizer arm pivotally connected to said body and a stabilizer guide for said arm mounted to said base.

13. A tool fixture according to claim 12, said arm having a square configuration and said guide having an aperture receiving said arm, said aperture including side apex portions with respect to which sides of said arm have a sliding fit.

14. A tool fixture, including a body providing a recess to receive a part to be held in said body for a machining or like operation, a tongue pivotally mounted on said body to be raised from and lowered to a position achieving an interfitting relation to an installed part resting on a supporting surface of said body, means for imparting a lateral thrust to an installed part urging it to a contacting relation with a side wall of said body recess, means for urging said tongue in a pivotal sense in a direction to seat the part to said supporting surface, and a single means for activating said means for imparting a lateral thrust and said means for urging said tongue in a pivotal sense.

15. A tool fixture according to claim 14, said means for imparting a lateral thrust to an installed part including a longitudinally displaceable pin carried by said tongue to project therethrough at one end to engage a portion of an installed part in a lowered position of said tongue, an opposite end of said pin extending to be accessible for activation by said actuating means.

16. A tool fixture according to claim 15, said actuating means including a cam rotatably mounted on said body, and means responsive to rotation of said cam to apply and to release endwise thrusting pressure to the said opposite end of said pin.

17. A tool fixture according to claim 16, said cam having a surface cooperative with said tongue to utilize rotation of said cam to apply endwise thrusting pressure to the said opposite end of said pin to effect at about the same time a pivotal urging of said tongue in a direction to press an installed part to a seat on said supporting surface.

18. A tool fixture according to claim 17, wherein said cam has a surface controlling the application and release of endwise thrusting pressure to said pin, said cam being so structured and arranged relative to means actuated thereby that said surfaces thereon effect in response to a rotary motion of said cam in one direction a relatively quick endwise thrust of said pin followed by a more gradual pivotal urging of said tongue until the part is effectively locked in place on the body.

19. A tool fixture according to claim 18, wherein the tongue has a pivotal connection with the body with a first portion projecting in one direction from said connection to overlie and engage an installed part and with a second portion projecting in the opposite direction, the said opposite end of said pin extending through said second portion of said pin, said cam having an inclined surface engageable with the said second portion of said tongue to effect a gradual lifting thereof in response to rotary motion of said cam in said one direction.

20. A tool fixture according to claim 19, said cam being mounted in a location spaced from said pivotal connection and said second portion of said tongue extending toward said cam in a cooperative relation with the said surfaces thereon.

21. A tool fixture according to claim 14, and means in an opposite side wall of said body recess deflected by an installation of a part in said recess applying a yielding pressure urging an installed part laterally toward the first said side wall.

* * * * *